US007726587B2

(12) United States Patent
Markley et al.

(10) Patent No.: US 7,726,587 B2
(45) Date of Patent: Jun. 1, 2010

(54) ROTARY IRRIGATION SPRINKLER NOZZLE

(76) Inventors: Kevin Markley, 552 S. Blue River Loop, Vail, AZ (US) 85641; James A. Elzey, 9243 E. Elderberry St., Tuscon, AZ (US) 85747

( * ) Notice: Subject to any disclaimer, the term of this patent is extended or adjusted under 35 U.S.C. 154(b) by 612 days.

(21) Appl. No.: 11/135,920

(22) Filed: May 23, 2005

(65) Prior Publication Data

US 2006/0273192 A1 Dec. 7, 2006

(51) Int. Cl.
*B05B 3/00* (2006.01)

(52) U.S. Cl. ..... 239/247; 239/246; 239/225.1; 239/457; 239/518; 239/DIG. 1

(58) Field of Classification Search ..... 239/225, 239/246, 451–460, 200–210, 225.1, 247, 239/518, DIG. 1
See application file for complete search history.

(56) References Cited

U.S. PATENT DOCUMENTS

| | | | | | |
|---|---|---|---|---|---|
| 3,684,192 | A | * | 8/1972 | McMillan | 239/452 |
| 3,762,650 | A | * | 10/1973 | Radecki | 239/396 |
| 3,812,882 | A | * | 5/1974 | Taylor | 137/556.6 |
| 4,131,234 | A | * | 12/1978 | Pescetto | 239/457 |
| 4,289,277 | A | * | 9/1981 | Allenbaugh | 239/452 |
| 4,501,391 | A | | 2/1985 | Hunter | |
| 4,625,917 | A | * | 12/1986 | Torney | 239/446 |
| 4,681,263 | A | * | 7/1987 | Cockman | 239/391 |
| 4,844,344 | A | * | 7/1989 | Manhardt et al. | 239/590 |
| 4,984,739 | A | * | 1/1991 | Allport | 239/193 |
| 5,050,800 | A | * | 9/1991 | Lamar | 239/201 |
| 5,240,184 | A | * | 8/1993 | Lawson | 239/499 |
| 5,299,742 | A | * | 4/1994 | Han | 239/206 |
| 5,381,959 | A | * | 1/1995 | Malkin | 239/201 |
| 5,598,977 | A | * | 2/1997 | Lemme | 239/246 |
| 5,820,029 | A | * | 10/1998 | Marans | 239/542 |
| 6,158,675 | A | * | 12/2000 | Ogi | 239/396 |
| 6,264,117 | B1 | | 7/2001 | Roman | |
| 6,332,581 | B1 | * | 12/2001 | Chin et al. | 239/246 |
| 2003/0218082 | A1 | | 11/2003 | Malcolm | |

* cited by examiner

*Primary Examiner*—Dinh Q Nguyen
(74) *Attorney, Agent, or Firm*—Fitch, Even, Tabin & Flannery

(57) ABSTRACT

An irrigation sprinkler nozzle for use in a rotary sprinkler for projecting the entire fluid stream between about 15 and about 35 feet from the rotary sprinkler regardless of the upstream pressure. The irrigation sprinkler nozzle comprises a nozzle body having a longitudinal axis, a side wall, and an exit wall. Coupled to the nozzle body is a restrictor plate that is spaced from the exit wall. Defined by the side wall, the exit wall, and the restrictor plate is a fluid chamber. The nozzle includes an inlet to the chamber defined by the restrictor plate. Preferably, the inlet has a cross-sectional area so that a pressure inside the chamber is less than a pressure upstream of the inlet. The nozzle also has an outlet from the chamber defined by the exit wall for projecting a fluid stream outwardly from the irrigation sprinkler nozzle. The chamber may be configured to form a turbulent flow within the chamber.

21 Claims, 9 Drawing Sheets

ROTARY IRRIGATION SPRINKLER NOZZLE

FIELD OF THE INVENTION

The invention is directed to an irrigation sprinkler nozzle and, in particular, to a sprinkler nozzle for projecting a fluid stream a predetermined distance that is substantially independent of the inlet fluid source pressure.

BACKGROUND OF THE INVENTION

Typical irrigation systems use a variety of sprinkling devices depending on the size of the ground surface area that needs to be irrigated. A gear-driven rotor is commonly used to project a columnated fluid stream in excess of about 35 feet, but such rotor does not effectively or consistently project a similar stream at ranges under about 35 feet. A fixed spray head is commonly used to project a spray under about 15 feet, but such spray head does not perform effectively beyond about 15 feet. As a result, there is a gap at such mid-range distances between about 15 feet and about 35 feet from the sprinkling device where spray heads and gear-driven rotors do not effectively irrigate.

Modifying a gear-driven rotor to consistently provide a columnated fluid stream at these mid-range distances has been difficult to achieve. At such mid-range distances, the gear-drive rotor and nozzle assembly usually suffer from one of several shortcomings. For instance, modified gear driven rotors that irrigate from about 15 to about 35 feet may have insufficient fluid flows to effectively operate both the gear-drive mechanism and the valve-in-head mechanism, unacceptable nozzle performance, or unpredictable throw distances when the inlet pressures varies.

One attempt to modify a gear-driven rotor to irrigate the mid-range distances uses pressure-reducing equipment to decrease the input flow rate or fluid pressure to the rotor device itself. Such low-flow rotors achieve shorter throw distances because the fluid in the rotor has a low velocity and, therefore, does not have enough energy to travel large distances. However, because rotors often use the fluid flow to operate both a gear-drive mechanism to rotate the nozzle head and a valve-in-head mechanism as a check-valve to prevent back flow, a minimum threshold fluid flow and pressure is required to reliably operate both mechanisms in the rotor at the same time. Current low-flow rotors are not designed to function with fluid pressures and flow rates sufficient to operate the gear drive and open the valve in the rotary head in a reliable and consistent manner. In addition, decreasing the flow rate to the rotor forms a fluid stream with less energy. However, such lower-energy fluid streams are more susceptible to wind effects, which results in poor distribution and uniformity.

While reducing the fluid flow to the rotor may help achieve shorter throw distances, such low flow rates also introduce variability into the performance of the nozzle. The quality of the projected stream, as a result, is often susceptible to changes in input fluid pressure, which results in unpredictable nozzle performance. Such low-flow rotors generally have a very small range of operating pressures in which they efficiently irrigate. For example, with pressure fluctuations, the low-flow rotor will result in higher or lower fluid velocities at the nozzle exit and, therefore, longer or shorter throw distances. With large pressure increases, the low-flow rotor may experience a substantial increase in the pressure drop across the nozzle exit, which may also result in a fluid stream having much smaller fluid droplets than desired. Such a stream results in misting, which generates poor distribution and uniformity, as well as a fluid stream that is susceptible to wind effects.

The narrow pressure range of current low-flow rotors limits its practical application. Many commercial irrigation systems, such as systems installed at golf courses, usually operate at very high pressures due to the need to irrigate large areas; therefore, the low-flow rotors cannot be installed in such systems without additional pressure reducing equipment. As a result, installation becomes more difficult because the irrigation system requires pressure optimization for the low-flow rotor and expensive due to additional equipment. In many cases, the fluid pressure would need to be tailored to the specific location of each low-flow rotor with a variety of different pressure reducing equipment. Moreover, even with such pressure reducing equipment, the pressure in the system may still vary, which would also result in the unpredictable performance, such as varying throw distances or misting and poor spray distribution.

Another attempt at modifying gear-driven rotors to irrigate the mid-range distances uses more typical fluid pressures, but modifies the configuration of the nozzle exit such that the stream trajectories are altered. For example, some rotor nozzle outlet configurations have been designed to distribute a fluid having an extremely wide, wedge shaped stream or a vertically elongated stream. Such nozzle configurations attempt to effectively spread the energy of the high pressure stream over a wide surface area or spread the fluid stream vertically to layer the fluid over a smaller surface area. However, such nozzle designs often result in poor scheduling coefficients and poor distribution uniformity, which inefficiently irrigates the desired surface area. The scheduling coefficient measures how much extra watering a predetermined area must receive for every section of that area to receive sufficient water. The wide distribution often irrigates unwanted areas and the vertical distribution often irrigates too heavily. Moreover, such wide or vertical streams are also more susceptible to wind, which results in a stream that is difficult to predict and control. Similar to the low-flow rotors described above, these modified nozzle outlets are still susceptible to pressure variations that cause deviations in the throw distance and droplet size.

Rotary sprinklers have also been modified to irrigate mid-range distances utilizing multiple nozzle outlets to partition the fluid into separate fluid streams. Partitioning of the fluid divides the fluid energy between several nozzle outlets for achieving a range of throw distances and distribution patterns from a single irrigation device. For instance, a nozzle may direct a majority of the fluid through a range nozzle and then bleed a portion of the fluid through a separate spreader nozzle. Often the flow path to the spreader nozzle directs the portion of the fluid flow through an inlet opening to drop the fluid pressure and velocity prior to the spreader nozzle outlet so that such nozzle can project a fan-shaped spray of relatively narrow horizontal width short distances. While the spreader nozzle projects a spray shorter distances, it is designed only to project a small portion of the fluid in a spray distribution rather than the entire high-pressure fluid in a columnated stream similar to a range nozzle. If the entire fluid stream was directed to a spreader nozzle, the high flow rates and pressure drops that would be experienced at the nozzle outlet would result in small water droplets, nozzle misting, and unpredictable sprays that would not reliably irrigate the mid-range distances.

Modifying spray heads to project a spray pattern beyond 15 feet has also been difficult. The spray head is generally limited in size by the spray head housing; therefore, the nozzle configuration, the deflector plate size, and the typical supply pressures are restricted. Therefore, the spray pattern generally has limits to the distribution and throw distances that can be reliably achieved. For instance, at existing fluid pressures, modifying the nozzle and deflector plate configuration to project a spray further distances would result in misting, small fluid droplets, and unpredictable sprays. On the other hand, increasing fluid pressures to the spray head, even if practical, would also not reliably increase spray distances. With the limitations in the size of the nozzle housing, increasing the fluid pressure to achieve a longer throw distance will generally not result in longer throws, but large pressure drops across the nozzle outlets resulting in small fluid droplets, misting of the spray, and unpredictable distributions.

Accordingly, there is a desire for a rotary nozzle that can accommodate varying input fluid pressures to achieve precipitation rates and distribution patterns of traditional long distance range nozzles, but have a predictable throw distance and uniformity between about 15 and about 35 feet from the nozzle with sufficient flow to operate both the valve-in-head mechanism and the gear-drive mechanism.

DESCRIPTION OF THE PREFERRED EMBODIMENTS

Figure 1:
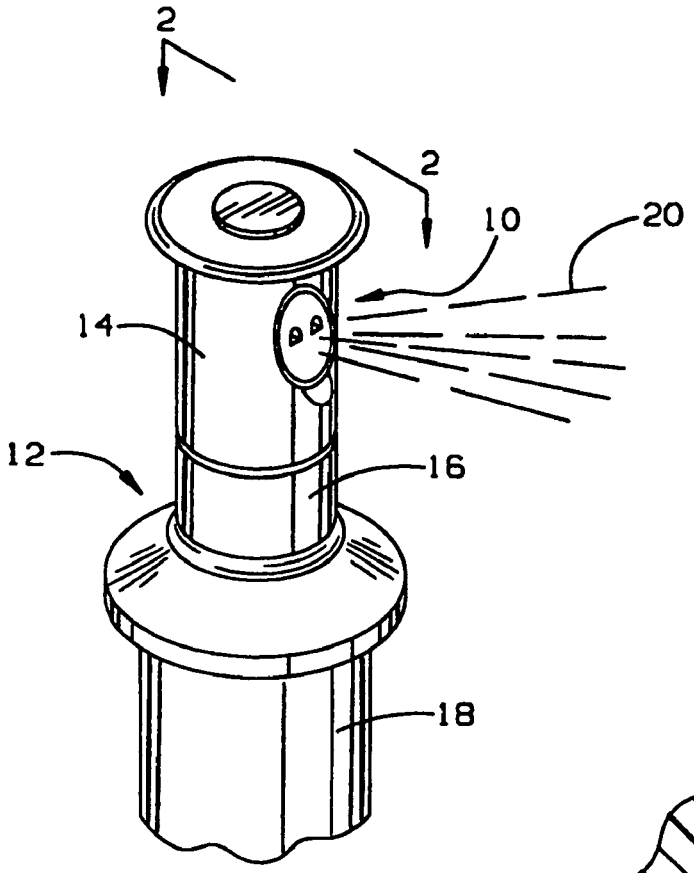
FIG. 1 is a perspective view of an exemplary irrigation sprinkler containing an exemplary irrigation nozzle that embodies features of the present invention.
Figure 2:
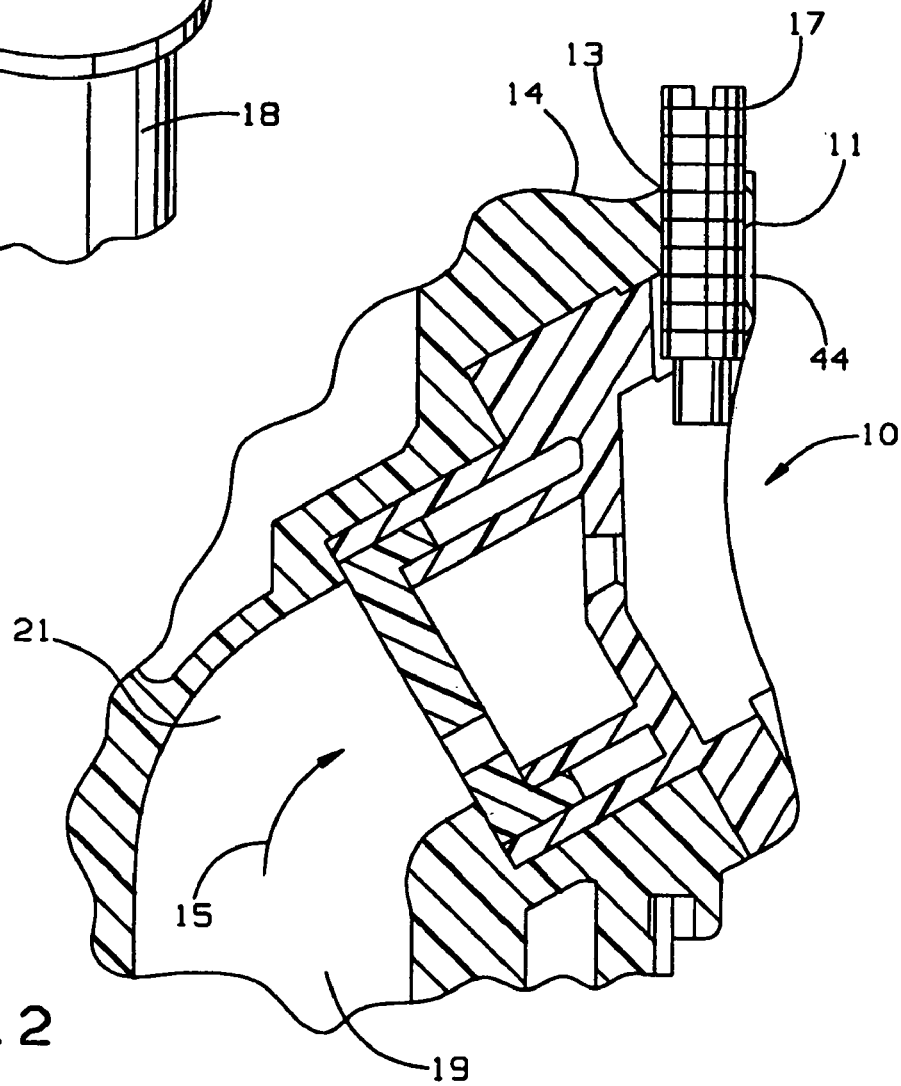
FIG. 2 is a partial cross-sectional view of the sprinkler of FIG. 1 taken along line 2-2 of FIG. 1.
Figure 3:
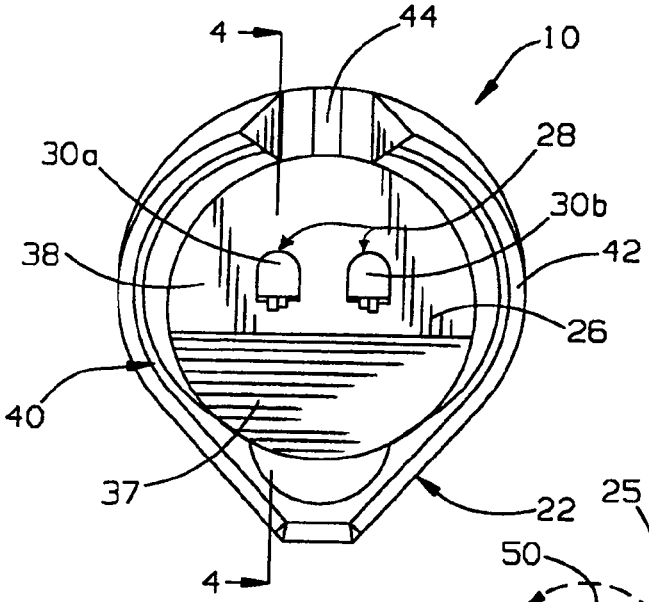
FIG. 3 is a front elevational view of an exemplary nozzle of the sprinkler of FIG. 1.

Referring to FIGS. 1 and 2, there is disclosed a sprinkler nozzle 10 for use in an irrigation sprinkler 12, such as a rotary sprinkler. The sprinkler nozzle 10 is mountable in a rotary nozzle housing 14 to project a fluid stream 20 a predetermined distance from the sprinkler 12. As illustrated, the nozzle housing 14 is coupled to a pop-up riser 16 that is housed within a casing or body 18 to form the rotary irrigation sprinkler 12. Under fluid pressure, the nozzle housing 14 and riser 16 telescopically extend out of the casing 18 so that the nozzle housing 14 may rotate to project the stream 20 onto a ground surface area from an elevated position. The nozzle 10 modifies the characteristics of an entire input fluid flow such that the fluid stream 20 can be projected the predetermined distance from the sprinkler 12 substantially independent of the inlet fluid pressure to the sprinkler 12. The exemplary stream 20 defines a columnated stream of fluid that has a distribution pattern similar to a traditional range nozzle on a rotary sprinkler, but is projected the predetermined, consistent distance, which for a particular nozzle is a distance within the range from about 15 to about 35 feet from the sprinkler 12. For example, a columnated stream may be a grouping of discrete fluid droplets producing a fluid stream generally in the shape of a column.

As illustrated in FIG. 2, the nozzle 10 is preferably configured to be mounted into a cavity 11 formed in the nozzle housing 14. As shown by the arrows 15, a pressurized fluid is provided to the sprinkler 12 and directed upwardly through the nozzle housing 14 in a tubular conduit 19 that is formed inside both the riser 16 and the nozzle housing 14. The fluid 15 is directed through an elbow 21 of the conduit 19 into the nozzle 10 so that the stream 20 may be formed and discharged from the sprinkler 12.

Referring to FIGS. 3 to 6, one exemplary embodiment of the nozzle 10 includes a body 22 coupled to a restrictor plate 24, which are both preferably fabricated out of molded plastic. The nozzle body 22 preferably has a generally cylindrical shape with a longitudinal axis Z. The body 22 includes an annular side wall 25 and a generally circular exit wall 26, which defines a nozzle outlet 28 with a predetermined shape and cross-sectional area. Spaced from the exit wall 26, the restrictor plate 24 defines a nozzle inlet 32 that also has a predetermined shape and cross-sectional area. The combination of the nozzle body 22 and the restrictor plate 24 defines an interior chamber 35. In general, the chamber 35 is defined by the restrictor plate 24 and the side wall 25 and the exit wall 26 of the body 22. The shape and area of the nozzle inlet 32, the chamber 35, and the nozzle outlet 28 modify the characteristics of the entire input fluid 15 such that the fluid stream 20 has the desired discharge pattern and range.

More specifically, the exit wall 26 is at one end of the side wall 25 and may include an enlarged head 40 surrounding the periphery of this end of the side wall 25. Accordingly, the exit wall 26 is recessed into the head 40 so that an outwardly projecting rim 42 encircles at least a portion of the head 40. A section of the rim 42 defines a fastener receiving slot 44. As shown in FIG. 2, when the nozzle 10 is mounted into the nozzle housing 14, a fastener or pin 17 may be received in the fastener receiving slot 44 to hold the nozzle 10 within the nozzle housing 14 or the pin 17 may function as a typical break-up pin that is projected into the stream 20 to further modify the characteristics of the stream discharged from the sprinkler. The pin 17 may be a threaded screw that is received in a threaded bore 13 within the housing 14.

The exit wall 26 may also be divided into different portions. For example, the exit wall 26 may include a first portion 37 and a second portion 38. The first portion 37 is preferably a lower area of the exit wall 26 and is generally parallel to the restrictor plate 24. In other words, the first portion 37 is generally perpendicular to the longitudinal axis Z. As described below, an inner surface of the first portion 37 provides a first impact surface 39 in the fluid flow path. That is, the fluid entering the cavity 35 through the inlet 32 contacts the impact surface 39, which redirects the fluid and generally imparts turbulence to the fluid flow prior to exiting through the nozzle outlet 28.

The second portion 38 of the exit wall 26 is generally an upper area of the exit wall 26 located adjacent or above the first portion 37. The second portion 38 is generally angled outwardly and away from the restrictor plate 24 or angled toward the longitudinal axis Z in the direction outward of the nozzle 10. The second portion 38 also defines the nozzle outlet 28; therefore, the outward angle of the second portion 38 preferably assists in forming the trajectory of the stream 20. In the illustrated embodiment, the nozzle outlet 28 is a pair of spaced outlet orifices 30*a* and 30*b* that combine to form the cross-sectional area of the outlet 28. While the outlet orifices 30*a* and 30*b* are illustrated as tombstone-shaped openings, the nozzle outlet 28 may also include a different number or variety of differently sized and shaped orifices depending on the precipitation rate and distribution pattern of the stream desired.

Figure 4:
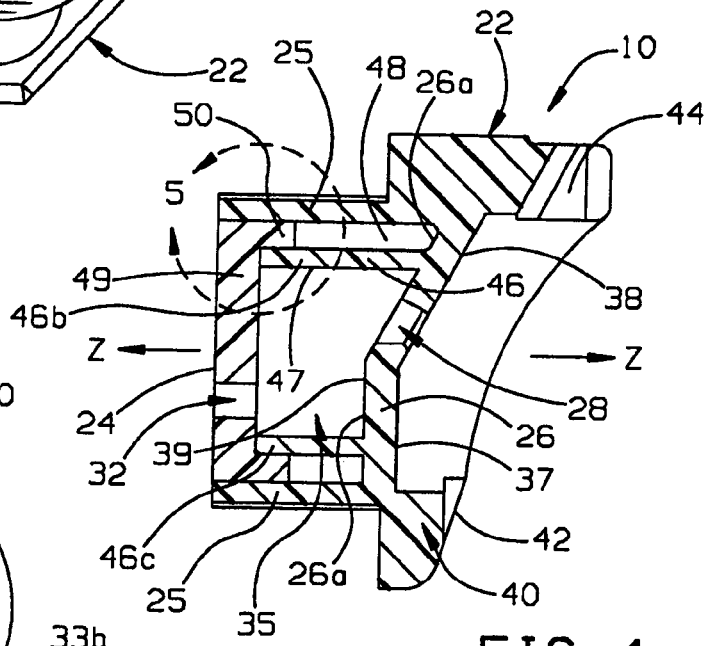
FIG. 4 is a cross-sectional view of the nozzle of FIG. 3 taken along line 4-4 of FIG. 3.
Figure 5:
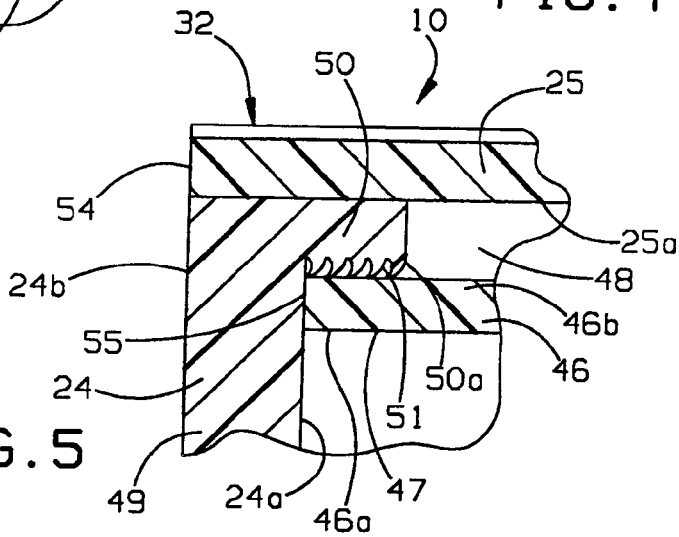
FIG. 5 is an enlarged cross-sectional view of the region in the circle of FIG. 4.

As best illustrated in FIGS. 4 and 5, the side wall 25 of the body 22 and an internal annular wall 46, defining in part the chamber 35, cooperate to define an annular slot 48 that is used to mount the restrictor plate 24 to the body 22. In this regard, the annular wall 46 is radially spaced inwardly from an inside surface 25*a* of the annular side wall 25 and extends outwardly from an inside surface 26*a* of the exit wall 26. In this embodiment, it is the spacing between the interior annular wall 46 and the outer wall 25 that defines the annular slot 48. As shown in FIG. 5, the interior annular wall 46 is preferably closely spaced to the side wall inside surface 25*a* so that the annular slot 48 is a relatively narrow space therebetween. Therefore, as described more below, the slot 48 and the annular wall 46 may also be used to secure the restrictor plate 24 to the nozzle body 22 via a friction fit. In addition, as best shown in FIG. 4, the annular wall 46 generally has two different axial lengths depending on which portion of the exit wall 26 the wall 46 extends from. For example, because the exit wall second portion 38 angles outwardly, a portion 46*b* of the wall 46 extending therefrom will have a longer axial length than a portion 46*c* that extends from the exit wall first portion 37, which is generally perpendicular to the axis Z. The wall portion 46*b* may also form a second impact surface 47 for the fluid within the nozzle 10. The second impact surface 47 may redirect the fluid and also impart further turbulence to the fluid within the chamber 35. As illustrated, in this embodiment the chamber 35 is further defined by the restrictor plate 24, the annular wall 46, and the exit wall 26.

An inside surface 46*a* of the annular wall 46 also defines the radial boundaries of the nozzle chamber 35. Therefore, a volume of the nozzle chamber 35 is generally a cylindrical space defined by the exit wall inside surface 26*a*, the annular wall inside surface 46*a*, and an inside surface 24*a* of the restrictor plate 24. In one exemplary embodiment, the inside diameter of the annular wall 46 adjacent the restrictor plate 24 is about 0.240 inches, the axial length of the annular wall portion 46*c* is about 0.180 inches, and the axial length of the annular wall portion 46*b* is about 0.240 inches. Therefore, one exemplary volume of the chamber 35 can be calculated therefrom. As will be further described below, the volume of fluid in the nozzle chamber 35 generally has a lower pressure and more turbulence than the input fluid 15 in the conduit 19.

The restrictor plate 24 is a structure or other obstruction within the fluid flow path 15 to preferably control the fluid flow rate and pressure prior to the nozzle outlet 28. That is, the restrictor plate 24 may be a restriction or other pressure reducing member within the fluid flow path so that only a controlled amount of fluid enters the chamber 35 and exits through the nozzle outlet 28. In one form, the restrictor plate 24 includes a generally circular disk portion 49 having an outwardly extending flange portion 50 on a periphery thereof.

Figure 6:
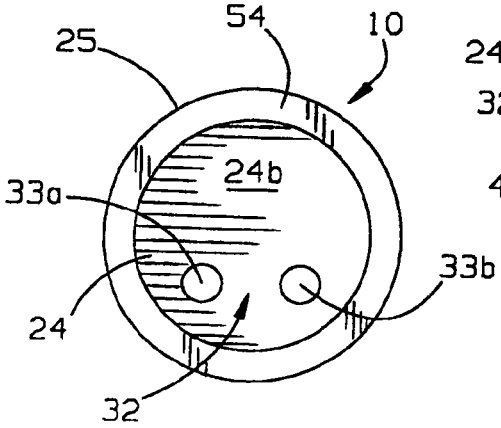
FIG. 6 is a rear elevational view of the nozzle of FIG. 3.

The disk portion 49 defines the nozzle inlet 32. As illustrated in FIG. 6, the nozzle inlet 32 is preferably a pair of inlet orifices 33*a* and 33*b*, which together form the cross-sectional area of the nozzle inlet 32. Preferably, the cross-sectional area of the nozzle inlet 32 generally controls the fluid within the nozzle 10. For instance, the cross-sectional area of the inlet 32 is selected to modify the characteristics of the fluid 15 entering the nozzle chamber 35 from the tubular conduit 19 such that, as previously mentioned, the nozzle chamber 35 has a decreased fluid pressure. In this regard, the total cross-sectional area of the orifices 33*a* and 33*b* of the nozzle inlet 32 is generally less than a cross-sectional area of the tubular conduit 19 so that the fluid in the conduit 19 is forced through a smaller area. The throttling of the fluid 15 through smaller diameter orifices, such as the orifice 33*a* and 33*b*, imparts a relatively large pressure drop on the fluid; therefore, the fluid after the nozzle inlet 32 generally has a lower pressure than if no restrictor plate 24 was within the flow path.

The cross-sectional area of the inlet 32 may also control the flow rate and velocity of the fluid exiting the nozzle outlet 28. In this regard, the total cross-sectional area of the inlet 32 may be varied relative to the total cross-sectional area of the outlet 28 to control the fluid flow. For example, in one exemplary nozzle, it has been found that a ratio of the total cross-sectional area of the nozzle exit 28 to the total cross-sectional area of the nozzle inlet 32 may range from about 0.70 to about 3.0 to form the stream 20. However, for other nozzles different ratios may also be acceptable. Preferably, it has been found that the total cross-sectional area of the inlet 32 should be smaller than the total cross-sectional area of the outlet 28 to form the desired stream 20. As a result, because the fluid within the chamber 35 has a lower pressure, it also has a lower flow rate and lower velocity at the nozzle outlet 28 so that the fluid has less energy at the nozzle outlet 28, which achieves lower throw distances.

The restrictor plate 24 is coupled to the side wall 25 at an end opposite the exit wall 26 so that the chamber 35 is formed therebetween. To couple or otherwise secure the plate 24 to the nozzle body 22, the flange 50 may be inserted into the annular slot 48, preferably, with a friction fit. However, the restrictor plate 24 may also be welded, glued, threaded, or coupled to the nozzle body through other attachments. To assist in forming the friction fit, an inside surface 50*a* of the flange 50 may include a plurality of annular crush ribs 51, as illustrated in FIG. 5. Therefore, when the restrictor plate flange 50 is inserted into the slot 48, the crush ribs 51 deflect inwardly toward the plate inside surface 24*a* to help frictionally secure the restrictor plate 24 to the nozzle body 22 and also to provide a generally water-tight seal. In one form, the crush ribs 51 are spaced flexible members that circumscribe the inside flange surface 50*a* and may be about 0.030 inch thick. However, other thicknesses are appropriate so long as the ribs 51 frictionally secure the flange 50 within the slot 48.

When coupled to the nozzle body 22, it is preferred that an outside surface 24*b* of the restrictor plate 24 is flush with a distal end 54 of the nozzle body annular side wall 25. To accommodate such configuration, the annular wall 46 may have a axial length that is less than the axial length of the nozzle side wall 25. In a preferred embodiment, this difference is about the same as the thickness of the restrictor plate 24 to form such flush association between the restrictor plate 24 and the nozzle body 22. For example, in one form, it is preferred that the restrictor plate 24 is about 0.070 inches thick; therefore, the difference in length between a annular wall distal end 55 and the side wall distal end 54 is also about 0.070 inches. However, as further described below, the thickness of the restrictor plate 24 may vary depending on the fluid characteristics and range of stream 20 desired; therefore, this difference may vary accordingly.

Figure 7:
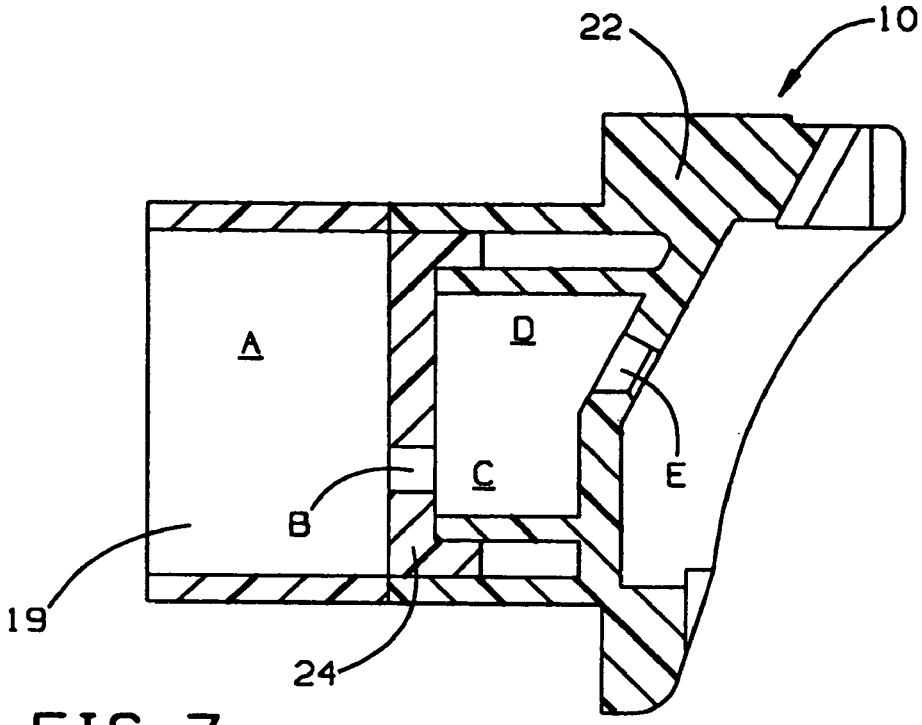
FIG. 7 is a cross-sectional schematic view of the nozzle of FIG. 4 illustrating exemplary sampling locations for flow analysis.
Figure 8:
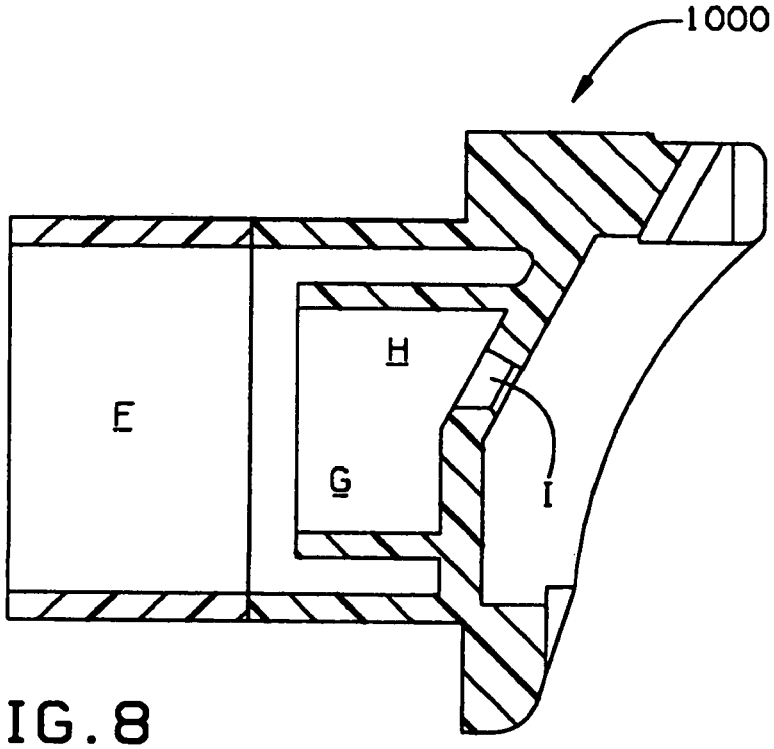
FIG. 8 (PRIOR ART)
FIG. 8 is a cross-sectional schematic view of a prior art nozzle indicating sampling locations for flow analysis.

Referring to FIGS. 7 and 8 and Table 1 below, a general comparison of the fluid characteristics in the nozzle 10 (FIG. 7) to a prior art nozzle 1000 (FIG. 8) without the restrictor plate 24 is provided to illustrate generally how the nozzle 10 modifies the fluid flow. Table 1 provides the fluid characteristics at various locations in the exemplary nozzles with and without restrictor plates, which are labeled in FIGS. 7 and 8. The restrictor plate 24 in conjunction with the cross-sectional area of the nozzle inlet 32, the cross-sectional area of the nozzle outlet 28, and the volume of the chamber 35 may be used to modify the characteristics of the fluid to decrease the fluid pressure, flow rate, and velocity prior to the nozzle outlet 28 to form the fluid stream 20.

TABLE 1

Fluid characteristics of an irrigation nozzle with and without a restrictor plate.

| Nozzle Location | Pressure, psi | Velocity, fps | Flow Rate, gpm | Throw Distance |
|---|---|---|---|---|
| With Restrictor Plate (FIG. 7): inlet 0.0057 $in^2$ and outlet 0.012 $in^2$ | | | | |
| A | 70 | 9-18 | — | 16 |
| B | 15-24 | 70-90 | — | |
| C | 24-34 | 55-82 | — | |
| D | 24-34 | 9-18 | — | |
| E | 15-24 | 27-46 | 1.3 | |
| Without Restrictor Plate (FIG. 8): outlet 0.012 $in^2$ | | | | |
| F | 70 | 14-27 | — | 22 |
| G | 70 | 13-40 | — | |
| H | 70 | 14-27 | — | |
| I | 18-44 | 68-82 | 2.0 | |

It is also preferred that the inlet 32 and the outlet 28 are misaligned so that the fluid does not flow directly therebetween. As shown in FIG. 4, while both the inlet 32 and the outlet 28 are generally parallel with the longitudinal axis Z, they are preferably offset from each other relative to the axis Z. For instance, the inlet 32 is disposed in a lower portion of the restrictor plate 24 and generally aligned with the impact surface 39, while the outlet 28 is disposed in an upper or the second portion 38 of the outlet wall 26. In this configuration, the nozzle inlet 32 and the nozzle outlet 28 are vertically offset from each other such that the fluid enters the lower part of the nozzle chamber 35 and exits the upper part of the nozzle chamber 35. While it is preferred that the entire inlet 32 is offset from the entire outlet 28, it is also acceptable to have a portion of each overlap.

As mentioned, the fluid in the chamber 35 preferably has a generally turbulent flow profile, which results from at least the fluid characteristics, the offset of the inlet 32 and the outlet 28, and the impact surfaces 39 and 47, as well as the overall shape of the chamber 35. For example, the offset of the inlet 32 and the outlet 28 forces the fluid within the chamber to follow a more tortuous flow path because the fluid cannot flow directly therebetween through the chamber 35. A portion of the fluid entering the chamber 35 is redirected by contacting the first impact surface 39 and/or the second impact surface 47 to impart further turbulence thereto.

Figure 9:
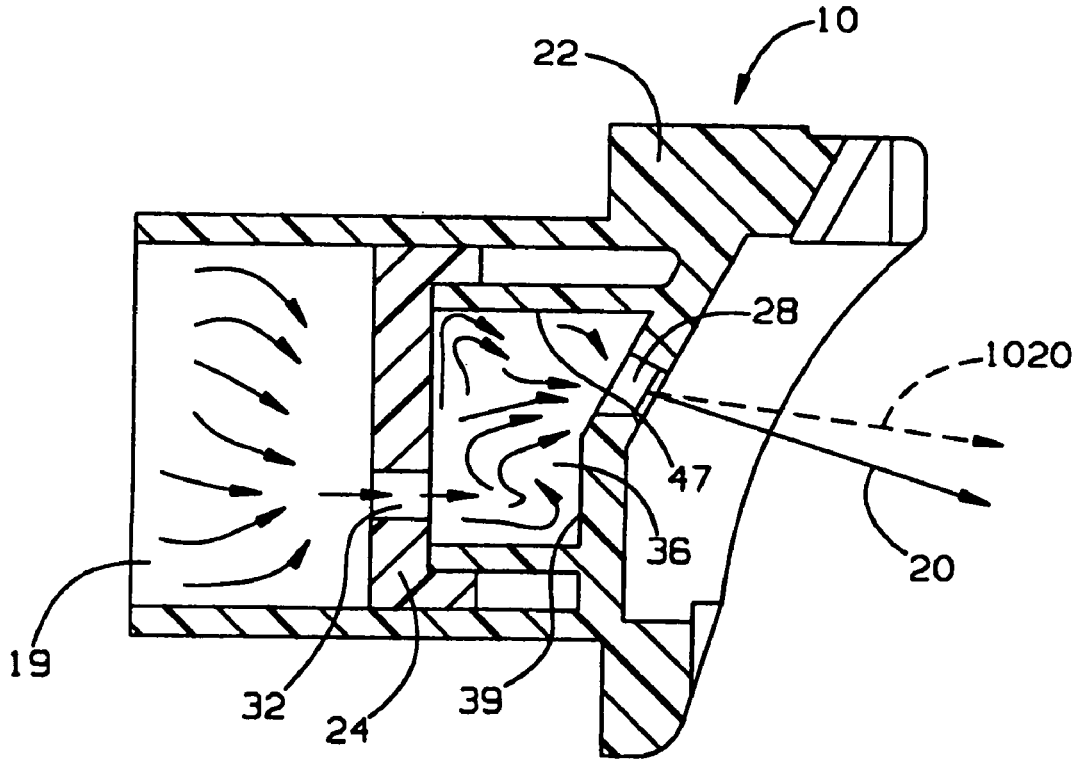
FIG. 9 is a cross-sectional schematic view of the nozzle of FIG. 4 illustrating exemplary flow velocity vectors.

More specifically, as shown in one exemplary embodiment in FIG. 9, a generally laminar fluid within the conduit 19 is preferably directed through the nozzle inlet 32 into the chamber 35 generally parallel to the longitudinal axis Z. As the fluid enters the chamber 35, at least a portion of the flow may cross the chamber 35 to contact the impact surface 39, which is then redirected. Some of the fluid also may travel generally upwardly in a turbulent profile across the axis Z where a portion may contact the second impact surface 47, wherein it may again be redirected prior to being discharged through the nozzle outlet 28. While the above description provides a general flow path in the chamber 35, the turbulence therein may also include other currents, eddies, or flow components consistent with a turbulent flow profile.

Figure 10:
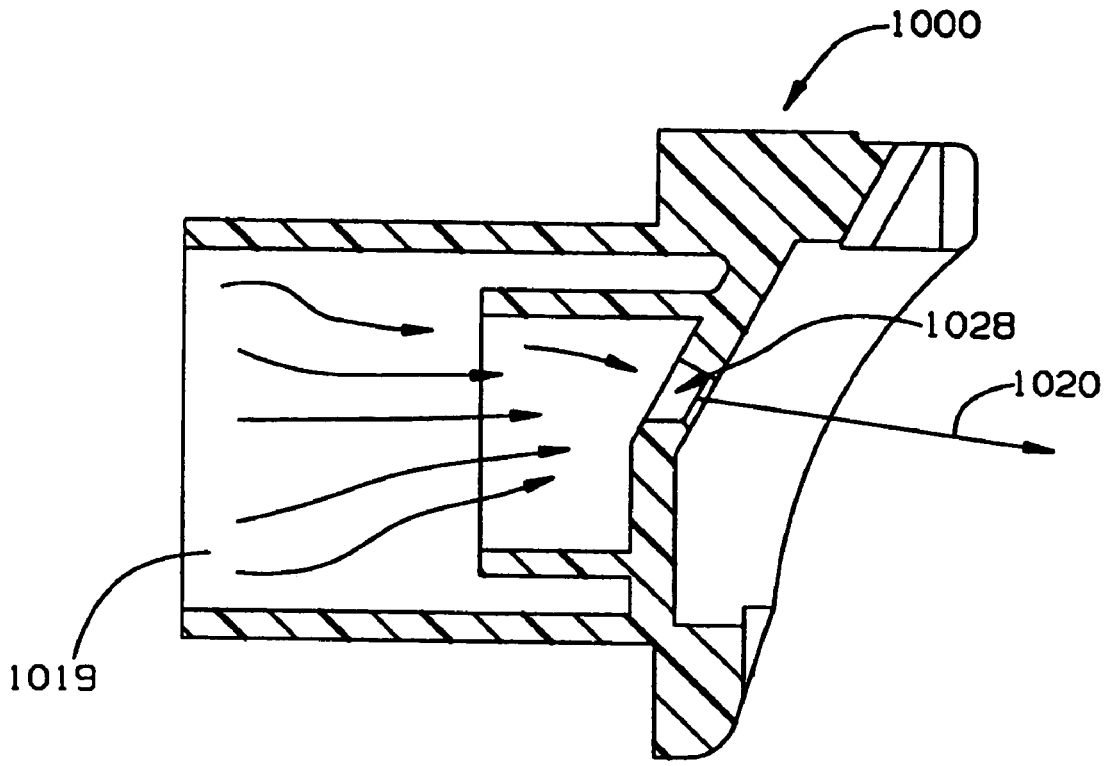
FIG. 10 (PRIOR ART)
FIG. 10 is a cross-sectional schematic view of a prior art nozzle illustrating exemplary fluid flow vectors.

The turbulent flow within the chamber 35 aids to decrease the stream 20 trajectory. In one instance, for example, it has been found that the turbulent flow within the chamber 35 decreases the stream trajectory about 5° to about 10° lower when compared to a stream created without a turbulent flow path prior to the nozzle outlet. FIGS. 9 and 10 compare exemplary fluid flow components of a prior art nozzle 1000 without a restrictor plate 24 (FIG. 10) to the nozzle 10 with the restrictor plate 24 (FIG. 9). As shown by the flow arrows in FIG. 10, the prior art nozzle 1000 generally has a more laminar-type flow in a conduit 1019 and a more laminar-type flow prior to an outlet 1028 resulting in a stream 1020 discharged from the nozzle 1000. On the other hand, as shown by the flow arrows in FIG. 9, the nozzle 10 has a generally more laminar-type flow in the conduit 19, but as described above, a more turbulent flow within the chamber 35 that results in the stream 20 having a lower trajectory from the nozzle 10 than the stream 1020, which is illustrated in FIG. 9 in phantom for comparison purposes. The turbulence aids to reduce the fluid flow rate sufficient to modify the stream 20 trajectory downwardly.

The nozzle 10 is also preferably configured to generate a consistent fluid stream 20 regardless of the fluid pressure within the conduit 19. That is, the restrictor plate 24 and the chamber 35 allow the nozzle 10 to preferably have a substantially consistent fluid pressure, flow rate, and exit velocity at the nozzle outlet 28 so that the stream 20 throw distance is generally a consistent distance even if the fluid pressure in the conduit 19 ranges from about 40 to about 100 psi. The relatively consistent distance (i.e., within +/−about two feet) for a particular sprinkler is maintained regardless of the fluid pressure. That is, the nozzle projects a columnated stream a consistent distance (+/−about two feet) within what is referred to as the mid-range, or a consistent distance (+/−about two feet) that falls between about 15 feet and about 35 feet from the sprinkler. In this regard, the volume of the chamber 35 generally absorbs and equalizes any fluid pressure variations within the conduit 19 so that the fluid characteristics at the nozzle outlet 28 are generally consistent. As a result, an irrigation sprinkler using the nozzle 10 would not require expensive pressure regulators to reduce the effects of pressure variations.

Table 2 below shows the pressure within the chamber 35, the flow rate at the outlet 28, and the corresponding throw distances obtained at varying pressures of the input fluid 15 in the conduit 19 of an exemplary irrigation nozzle 10 with the restrictor plate 24. The data in table 2 was obtained from a nozzle having a total cross-sectional area of the inlet 32 of 0.0057 square inches and a total cross-sectional area of the outlet 28 of 0.012 square inches.

TABLE 2

Fluid characteristics of an exemplary irrigation nozzle, such as nozzle 10, with a restrictor plate at varying input pressures.

| Input Pressure, psi | Nozzle Chamber Pressure, psi | Flow Rate at Nozzle Exit, gpm | Throw Distance, feet |
|---|---|---|---|
| 60 | 18-25 | 1.2 | 16 |
| 70 | 21-28 | 1.3 | 16 |
| 80 | 23-31 | 1.4 | 16 |
| 90 | 23-31 | 1.5 | 16 |
| 100 | 26-35 | 1.5 | 16 |

The nozzle 10 also improves the distribution profile of the stream 20 over a prior art nozzle 1000 without the restrictor plate 24. For instance, the pressure drops across the nozzle inlet 32 and the nozzle outlet 28, form a fluid stream 20 consisting of a larger droplet size than a stream formed from a nozzle without the restrictor plate 24. The larger fluid droplet size provides a more evenly distributed stream from the nozzle 10 that is less susceptible to wind effects and easier to project and control. Distribution of a irrigation stream is often evaluated through a scheduling coefficient (SC), distribution uniformity (DU), or coefficient of uniformity (CU). The CU and DU measure the uniformity of the irrigation. Such factors are a percentage, with 100% being the vest distribution and uniformity. The SC, on the other hand, is a measure of how much fluid is needed to cover a particular area. An SC of 1.0 is the best irrigation to be achieved by a particular nozzle. Table 3 below provides a comparison of the distribution parameters for exemplary nozzles with different cross-sectional areas for the inlet 32 and outlet 28 with and without the restrictor plate 24.

TABLE 3

Comparison of stream distribution parameters of an irrigation nozzle, such as nozzle 10, with and without restrictor plates.

| Restrictor Plate | Area Inlet, $in^2$ | Area Outlet, $in^2$ | Flow Rate Outlet, gpm | Range, feet | Distribution CU, % | Distribution DU, % | Distribution SC |
|---|---|---|---|---|---|---|---|
| No | 0.0057 | 0.0105 | 1.9 | 24 | 79 | 70 | 1.3 |
| Yes | 0.0057 | 0.0105 | 1.2 | 16 | 94 | 89 | 1.1 |
| No | 0.0101 | 0.1654 | 3.0 | 28 | 79 | 71 | 1.4 |
| Yes | 0.0101 | 0.1654 | 2.0 | 20 | 88 | 86 | 1.2 |
| No | 0.0167 | 0.0159 | 3.2 | 28 | 80 | 78 | 1.3 |
| Yes | 0.0167 | 0.0159 | 2.6 | 24 | 88 | 81 | 1.3 |
| No | 0.0157 | 0.1246 | 4.1 | 30 | 73 | 65 | 1.5 |
| Yes | 0.1057 | 0.1246 | 2.8 | 26 | 93 | 92 | 1.1 |
| No | 0.0119 | 0.2543 | 5.1 | 36 | 84 | 79 | 1.1 |
| Yes | 0.0119 | 0.2543 | 2.4 | 30 | 90 | 82 | 1.1 |
| No | 0.0103 | 0.0262 | 5.0 | 38 | 85 | 77 | 1.1 |
| Yes | 0.0103 | 0.0262 | 3.9 | 32 | 94 | 89 | 1.1 |

Figure 11:
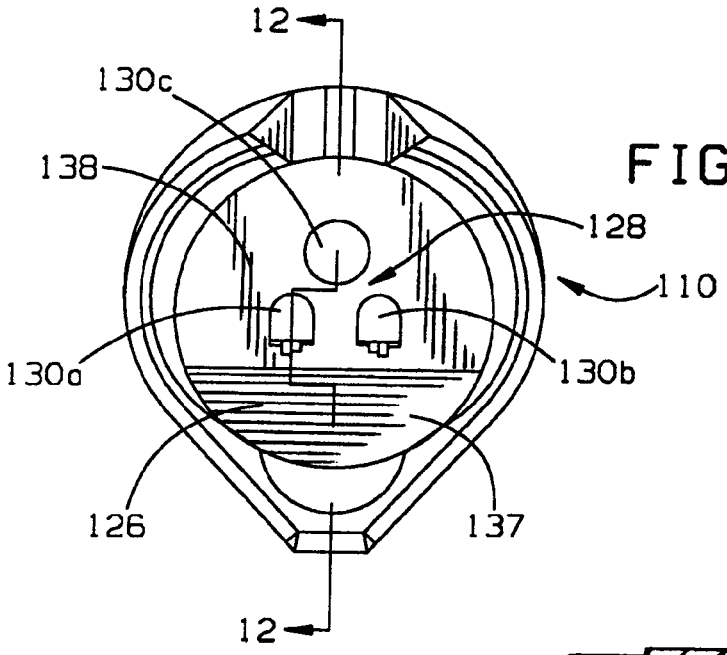
FIG. 11 is a front elevational view of an alternative exemplary irrigation nozzle embodying features of the present invention.
Figure 12:
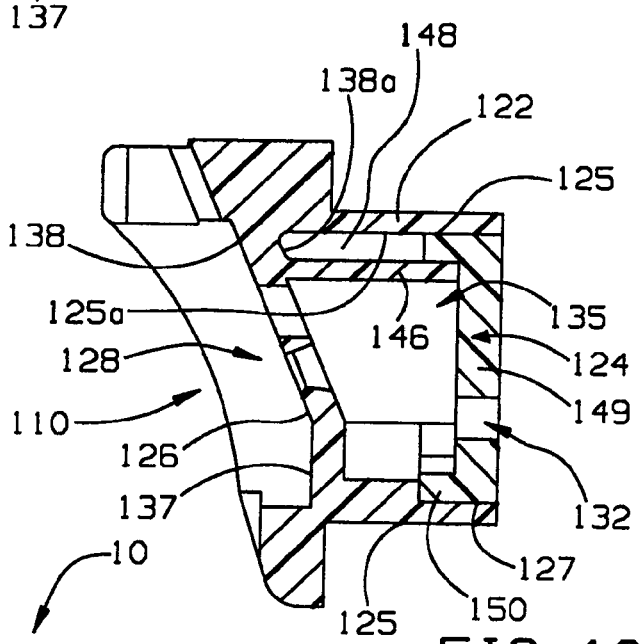
FIG. 12 is a cross-sectional view of the nozzle of FIG. 11 taken along line 12-12 of FIG. 11.

Referring to FIGS. 11-12, an alternative nozzle 110 is illustrated. The nozzle 110 is similar to nozzle 10 previously described, but includes a modified nozzle outlet 128 and a modified chamber 135. As with the nozzle 10, the nozzle 110 modifies the characteristics of the input fluid 15 to form a stream that is projected a consistent distance within the mid-range from the sprinkler 12 regardless of the inlet pressure. In this regard, the nozzle 110 resembles the previous embodiment with a nozzle body 122 coupled to a restrictor plate 124, which generally includes a disk portion 149 defining a nozzle inlet 132 and a peripheral flange portion 150. The differences between the nozzles 10 and 110 are described below.

The nozzle body 122 generally includes an annular wall 125 and a circular exit wall 126. The exit wall 126 defines a nozzle outlet 128, which has a predetermined cross-sectional area. In this embodiment, the nozzle outlet 128 is a plurality of outlet orifices 130*a*, 130*b*, and 130*c*. As illustrated, the outlet orifices may be different shapes and areas; however, the total cross-sectional area of the plurality of outlet orifices combine to form the cross-sectional area of the nozzle outlet 128. As with the prior embodiment, the exit wall 126 also includes different portions, such as a first portion 137 and a second portion 138; however, in this embodiment, the second portion 138 generally consist of more of the exit wall 126 because of the increased number of outlet orifices 130*a*, 130*b*, and 130*c* defined by the second portion 138.

An interior annular wall 146 defining in part the chamber 135 and the annular wall 125 of the body 122 define a restrictor plate receiving slot 148. More specifically, the interior annular wall 146 is spaced from an inside surface 125*a* of the annular wall 125. The interior annular wall 146 is preferably a semi-circular wall extending outwardly from an inside surface 138*a* of the exit wall second portion 138 and generally circumscribes the second wall portion 138. Therefore, in this embodiment, the restrictor plate receiving slot 148 is a generally semi-circular slot between the interior annular wall 146 and the side wall 125 of the body 122. A lower portion of the annular wall 125, which generally corresponds to the exit wall first portion 137, defines a notch 127 on the inside surface for receiving a portion of the restrictor plate 124.

As suggested by the differences in the chamber 135, the restrictor plate 124 is coupled to the nozzle body 122 in a different fashion than for the nozzle 10 discussed above. Because the slot 148 is semi-circular, a portion of the flange 150 is frictionally received within the slot 148 rather than the entire flange 150. The remaining portion of the flange 150 (i.e., the portion not received in the slot 148) rests in the notch 127 formed within the lower-half of the nozzle plate wall 125. As with the previous disclosed nozzle 10, the flange 150 may include ribs or other structure to increase the frictional engagement of the flange 150 in the slot 148 to aid in securing and holding the flange 150 in the slot 148.

Figure 13:
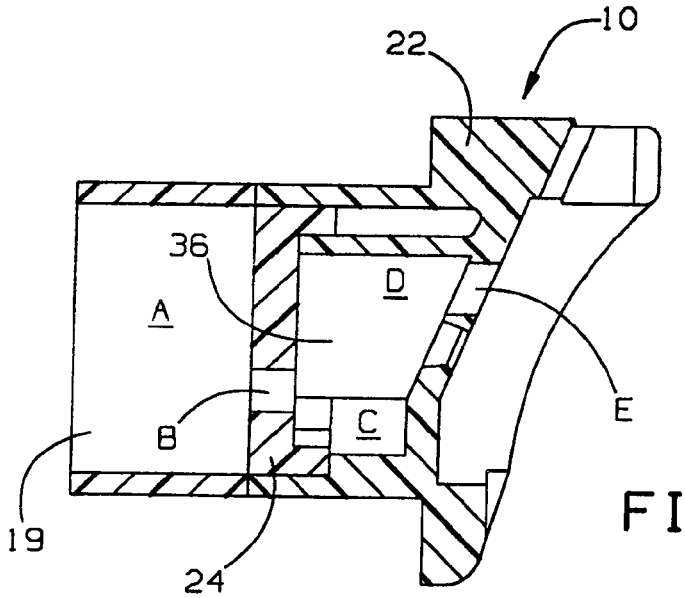
FIG. 13 is a cross-sectional schematic view of the nozzle of FIG. 12 illustrating exemplary sampling locations for flow analysis.
Figure 14:
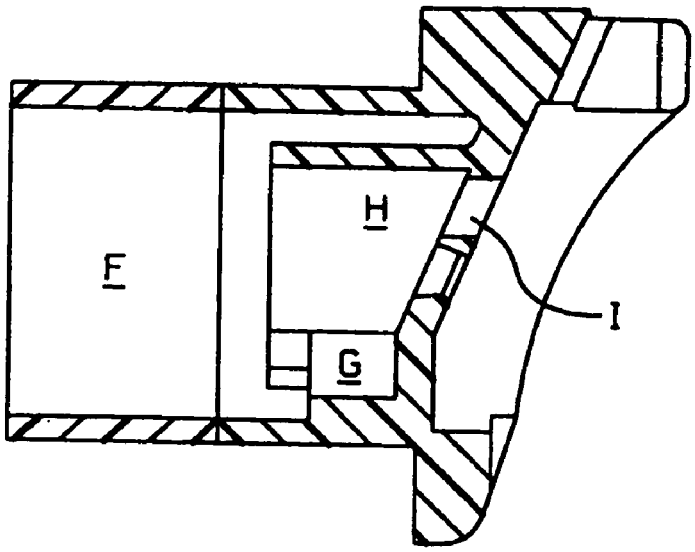
FIG. 14 (PRIOR ART)
FIG. 14 is a cross-sectional schematic view of a prior art nozzle indicating exemplary sampling locations for flow analysis.

The nozzle 110 also modifies the characteristics of the fluid flow to form a stream that is projected a consistent distance from the sprinkler 12 within the mid-range regardless of the input fluid pressure. Table 4, which refers to FIGS. 13 and 14, summarizes the fluid characteristics of an exemplary irrigation nozzle, such as nozzle 110, with and without the restrictor plate 24 at various nozzle locations indicated in FIGS. 13 and 14.

TABLE 4

Fluid characteristics of an exemplary irrigation nozzle with and without a restrictor plate.

| Nozzle Location | Pressure, psi | Velocity, fps | Flow Rate, gpm | Throw Distance |
|---|---|---|---|---|
| With Restrictor Plate (FIG. 13): inlet 0.0173 $in^2$ and outlet 0.026 $in^2$ | | | | |
| A | 70 | 18-34 | — | 32 |
| B | 18-48 | 71-90 | — | |
| C | 18-48 | 13-61 | — | |
| D | 18-33 | 13-24 | — | |
| E | 4-19 | 13-61 | 3.4 | |
| Without Restrictor Plate (FIG. 14): outlet 0.026 $in^2$ | | | | |
| F | 70 | 13-24 | — | 38 |
| G | 70 | 13-24 | — | |
| H | 70 | 27-41 | — | |
| I | 5-24 | 42-97 | 5.4 | |

In addition, Table 5 below also illustrates how the exemplary nozzle 110 with the restrictor plate 124 provides substantially consistent fluid characteristics in the nozzle chamber 135 with varying input fluid pressures similar to the nozzle 10. The data in table 5 was obtained from a nozzle having a total cross-sectional area of the inlet 32 of 0.0173 square inches and a total cross-sectional area of the outlet 28 of 0.026 square inches.

TABLE 5

Fluid characteristics of an exemplary irrigation nozzle, such as nozzle 110, with a restrictor plate at varying inlet pressures.

| Input Pressure, psi | Nozzle Chamber Pressure, psi | Flow Rate at Nozzle Exit, gpm | Throw Distance, feet |
|---|---|---|---|
| 60 | 18-34 | 3.2 | 32 |
| 70 | 20-37 | 3.4 | 32 |
| 80 | 20-40 | 3.7 | 32 |

TABLE 5-continued

Fluid characteristics of an exemplary irrigation nozzle, such as nozzle 110, with a restrictor plate at varying inlet pressures.

| Input Pressure, psi | Nozzle Chamber Pressure, psi | Flow Rate at Nozzle Exit, gpm | Throw Distance, feet |
|---|---|---|---|
| 90 | 21-45 | 3.9 | 34 |
| 100 | 23-45 | 4.0 | 34 |

Referring to FIGS. 15A-15D, modified restrictor plates 24 are illustrated that include different configurations of the nozzle inlet 32. Each of the alternative restrictor plates 24 include the nozzle inlet 32 having a different cross-sectional area, a different number of inlet orifices 33, and/or different locations of the inlet orifices 33 relative to the disk surface 49 when compared to the restrictor plate 24 illustrated in FIG. 6. The modifications to the nozzle inlet 32 may vary the fluid characteristics within the nozzle chamber 35. For example, the different number, shape, or location of the inlet orifices may vary the fluid pressure, flow rate, and/or turbulence prior to the nozzle outlet 28 within the chamber 35 to modify either the range, spray distribution, and/or arc trajectory of the stream 20.

Figure 15A:
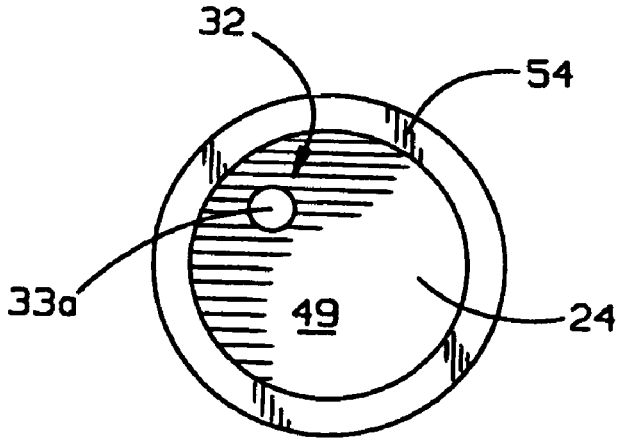
FIG. 15*a* is a rear elevational view of another alternative exemplary irrigation nozzle embodying features of the present invention.
Figure 15B:
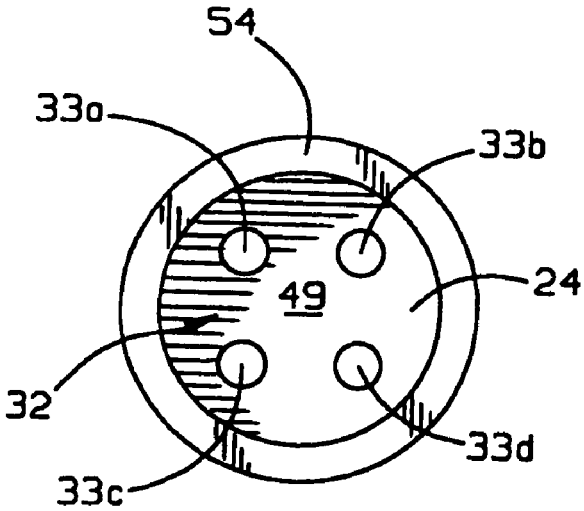
FIG. 15*b* is a rear elevational view of another alternative exemplary irrigation nozzle embodying features of the present invention.
Figure 15C:
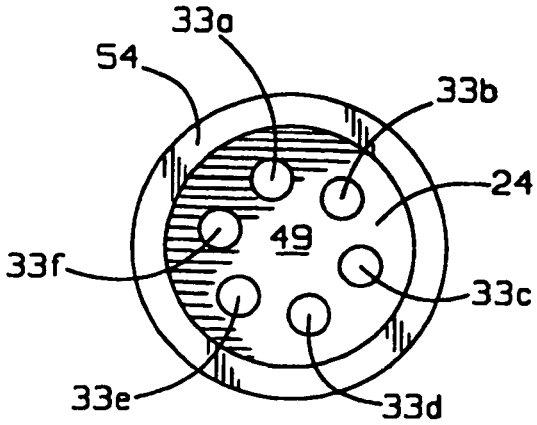
FIG. 15*c* is a rear elevational view of another alternative exemplary irrigation nozzle embodying features of the present invention.
Figure 15D:
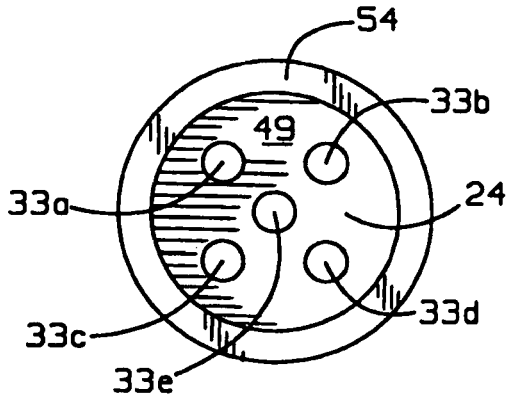
FIG. 15*d* is a rear elevational view of another alternative exemplary irrigation nozzle embodying features of the present invention.

For example, in FIG. 15*a*, the restrictor plate 24 defines a single inlet orifice 33*a*. While located in the upper left-hand corner of the disk surface 49, the single inlet orifice 33*a* may also be disposed in other locations on the restrictor plate 24. On the other hand, FIGS. 15*b* and 15*c* illustrate the restrictor plate 24 having a plurality of inlet orifices equally spaced radially and circumferentially around a central point of the disk surface 49. In FIG. 15*d*, the restrictor has four inlet orifices equally spaced radially and circumferentially about the center point of the disk surface 49 and further includes a centrally located inlet orifice. While each of the restrictor plates shows inlet orifices 33 as generally circular openings, the inlet orifices 33 may also be other shapes, such as rectangles, ovals, tombstone-shaped, or the like.

In each of the modified restrictor plates 24 shown in FIGS. 15*a*-15*d*, the total cross-sectional area of the various inlet orifices 33 combine to form the total cross-sectional area of the nozzle inlet 32. Furthermore, while it is preferred that the nozzle inlet 32 be offset from the nozzle outlet 28, with the modified restrictor plates 24 shown in FIGS. 15*a*-15*d*, not all inlet orifices 33 will be offset entirely from the nozzle outlet 28. Because of the larger number of inlet orifices 33 and/or increased cross-sectional area of the nozzle inlet 32, some overlap between the nozzle inlet 32 and the nozzle outlet 28 is likely. As a result, it is possible that some fluid will flow more directly therebetween.

Table 6 below summarizes how various nozzle fluid parameters are modified with different total cross-sectional areas of the inlet 32 and outlet 28. For example, the data provides the flow rate at the outlet 28 and the stream 20 range for various fluid pressures in the conduit 19. In general, with each of the exemplary nozzles, the range and flow rate is substantially consistent regardless of the input pressure to the nozzle.

TABLE 6

| Nozzle fluid parameters with varying total cross-sectional area on nozzle inlets and nozzle outlets | | | | | | | | | | | |
|---|---|---|---|---|---|---|---|---|---|---|---|
| Total inlet cross-sectional area, in$^2$ | Total outlet cross sectional area, in$^2$ | Range, feet | | | | | Flowrate, gpm | | | | |
| | | 60 psi | 70 psi | 80 psi | 90 psi | 100 psi | 60 psi | 70 psi | 80 psi | 90 psi | 100 psi |
| 0.0101 | 0.012 | 18 | 18 | 18 | 20 | 20 | 1.6 | 1.6 | 1.7 | 2.0 | 2.1 |
| 0.0119 | 0.018 | 22 | 22 | 24 | 24 | 24 | 2.5 | 2.6 | 2.8 | 3.0 | 3.2 |
| 0.0157 | 0.020 | 26 | 28 | 28 | 28 | 30 | 1.8 | 1.9 | 1.9 | 2.1 | 2.2 |
| 0.0157 | 0.026 | 30 | 30 | 32 | 32 | 34 | 2.4 | 2.5 | 2.7 | 2.8 | 3.0 |

Figure 16:
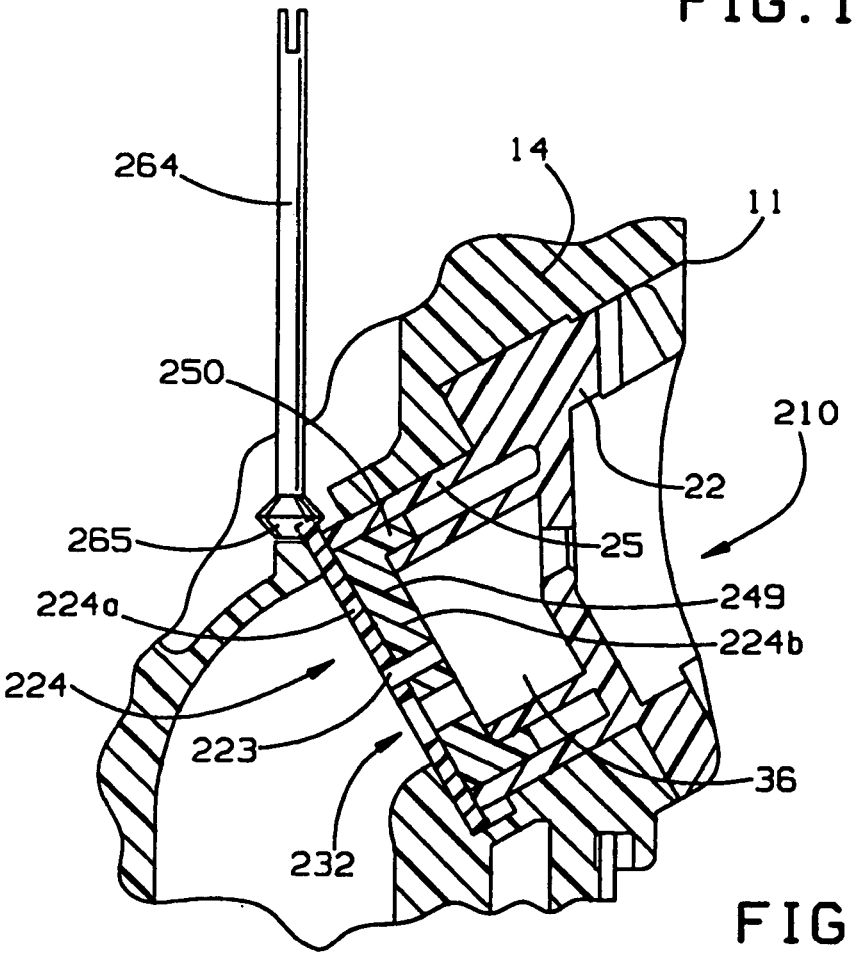
FIG. 16 is a partial cross-sectional view of the sprinkler of FIG. 1 taken along line 2-2 of FIG. 1 to illustrate an exemplary alternative irrigation nozzle for use with the sprinkler of FIG. 1 and embodying features of the present invention.
Figure 17:
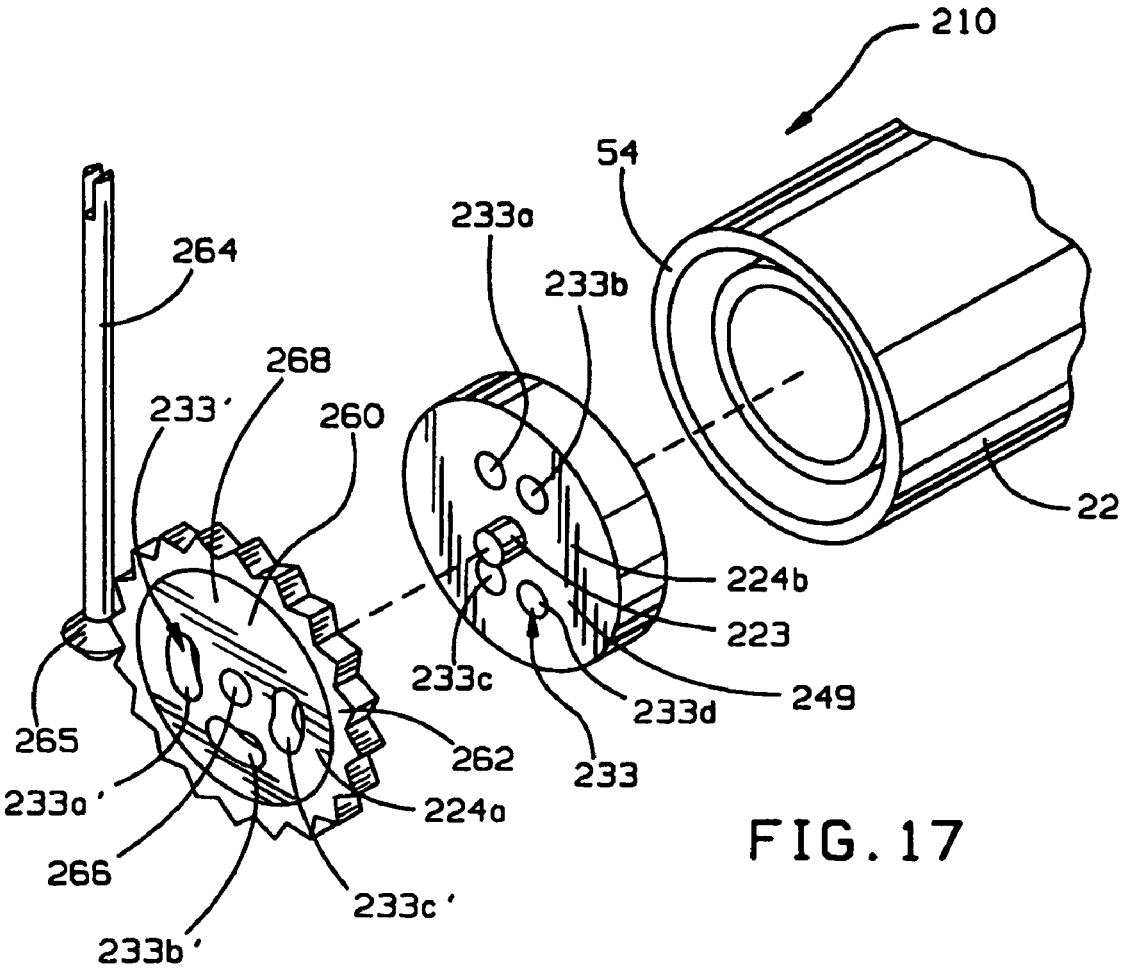
FIG. 17 is an exploded perspective view of the irrigation nozzle of FIG. 16.

Referring to FIGS. 16 and 17, a nozzle 210 is illustrated that includes the nozzle body 22, as previously described, coupled to another modified restrictor plate 224. The modified restrictor plate 224 includes a nozzle inlet 232 having a variable cross-sectional area that may be changed through use of a separate tool 264. Similar to the prior embodiments, the nozzle 210 may be received within the cavity 11 of the nozzle housing 14; however, the nozzle housing 14 would require an optional slot (not shown) for providing access to the modified restrictor plate 224 for the tool 264.

More specifically, the restrictor plate 224 includes a moveable member 224*a* rotatively coupled to a fixed member 224*b*. Each of the members 224*a* and 224*b* defines a portion of the nozzle inlet 232. That is, the nozzle inlet 232 includes orifices 233 in the fixed member 224*b* as well as orifices 233' in the moveable member 224*a*. The nozzle inlet 232 is formed by overlapping a portion of the moveable member orifices 233' with a portion of the fixed member orifices 233. The cross-sectional area of the inlet 232, therefore, varies depending on the amount of overlap between the orifices 233 and 233' as the moveable member 224*a* is positioned relative to the fixed member 224*b*.

The fixed member 224*b* is similar to the restrictor plate 24 having a disk surface 249 and a peripheral flange 250, but further includes a pin 223 extending therefrom providing an axis of rotation for the movable member 224*a* to be rotatively coupled thereto. Preferably, the pin 223 is centrally disposed on a disk surface 249. As with the restrictor plate 22, the flange 250 preferably frictionally couples the fixed member 224*b* to the nozzle body 22 in a flush engagement with the distal end 54 of the nozzle body side wall 25.

As indicated above, the fixed member 224*b* includes a portion of the nozzle inlet 232. As shown in FIG. 17, the fixed member 224*b* preferably includes a plurality of inlet orifices 233*a*, 233*b*, 233*c*, and 233*d* that are equally spaced from the central pin 223. Preferably, pairs of the orifices are closely spaced circumferentially such that one pair is disposed on an upper portion of the disk surface 249 and a second pair is disposed on a lower portion of the disk surface 249. For example, inlet orifices 633*a* and 633*b* may be closely spaced and inlet orifices 633*c* and 633*d* may be closely spaced, where each closely spaced pair is then radially spaced about the pin 223 on opposite sides thereof. However, other combinations, shapes, or numbers of orifices 233 are also acceptable.

The movable member 224*a* is preferably a circular disk 260 having a scalloped or geared circumferential edge 262 thereabout. As further described below, the geared edge 262 cooperates with the separate tool 264 for rotating the movable member 224*a* relative to the fixed member 224*b* to vary the cross-sectional area of the nozzle inlet 232. In order to couple with the fixed member 224*b*, the movable member 224*a* further defines a pin opening 266 centrally disposed and sized to rotatively receive the pin 223. When coupled to the fixed member 224*b*, the geared edge 262 preferably extends beyond an outer surface of the nozzle body side wall 25 so that the tool 264 may engage the geared edge 262. In one form, the tool 264 may have a gear 265 on one end for mating with the geared edge 262. The gear 265 and the gear edge 262 may form straight-tooth bevel gears so that the tool 264 may rotate the movable member 224*a* even when angled relative to the movable member 224*a*. Therefore, in one form, the moveable member 224*a* generally has a larger diameter than the nozzle body 22 and the fixed member 224*b*.

As discussed above, the movable member 224*a* also includes a portion of the nozzle inlet 232. In this regard, the moveable member 224*a* preferably defines a plurality of inlet orifices 233' that are equally spaced radially about the central opening 266. As shown in FIG. 17, the movable member 224*a* preferably includes three arcuate slotted orifices 233*a*', 233*b*', and 233*c*' that are radially spaced from the central opening 266. However, other combinations, shapes, or numbers of orifices 233' are also acceptable. Most preferably, the orifices 233' are spaced a radial distance from the central opening 266 that is similar to the distance the orifices 233 are spaced from the pin 223. Therefore, as the movable member 224*a* is rotated relative to the fixed member 224*b*, portions of the orifices 233 and 233' may overlap to define the nozzle inlet 232 as described above.

The cross-sectional area of the nozzle inlet 232 may vary from being closed to fully open depending on the amount of overlap between the orifices 233 and 233'. For example, the nozzle inlet 232 is substantially closed if the moveable member 224*a* is rotated such that a solid portion 268 of the disk 260 overlaps each of the fixed member inlet orifices 233*a*, 233*b*, 233*c*, and 233*d*. In this condition, substantially no fluid will flow through the nozzle 210. On the other hand, if the moveable member 224*a* is rotated such that a portion of one or more of the moveable member inlet orifices 233' overlaps a portion of one or more of the fixed member inlet orifices 233, then the nozzle inlet 232 has a predetermined cross-sectional area based on the amount of overlap between the orifices 233 and 233' resulting in a fluid having predetermined conditions in the nozzle chamber 35. If the moveable member 224*a* is rotated further so that a greater portion of the moveable member inlet orifices 233' overlap with the fixed member inlet orifices 233, an even larger cross-sectional area of the nozzle inlet 232 is formed resulting in different predetermined fluid conditions in the nozzle chamber 236.

As previously discussed, the fluid characteristics in the nozzle chamber 35 generally affect the throw distance of the stream projected from the sprinkler 12. In this embodiment, the modified restrictor plate 224 on the nozzle 210 allows the user to tailor the fluid characteristics within the nozzle chamber 35 and vary the throw distance, distribution, and/or trajectory of the stream 20 without having to interchange nozzle bodies 22. For example, with an increased cross-sectional area of the nozzle inlet 32, the consistent distance of the stream 20 is farther from the sprinkler 12. That is, the consistent, predetermined distance of stream 20 is closer to the outer limit of the mid-range or closer to about 35 feet from the sprinkler. On the other hand, with a decreased cross-sectional area of the nozzle inlet 32, the consistent distance of the stream 20 is closer to the sprinkler 12. That is, the consistent, predetermined distance of the stream 20 is doser to the inner limit of the mid-range or closer to about 15 feet from the sprinkler.

In addition, because the nozzle 210 includes the restrictor plate 224, the nozzle 210 further includes all the advantages of the nozzles 10 and 110 in that the nozzle 210 also preferably provides consistent fluid characteristics prior to the outlet 28 regardless of the input fluid pressure. Therefore, once the cross-sectional area of the nozzle inlet 232 has been set, as described above, the nozzle 210 will preferably project a fluid stream 20 a repeatable and consistent distance generally regardless of the input fluid pressure.

Figure 18:
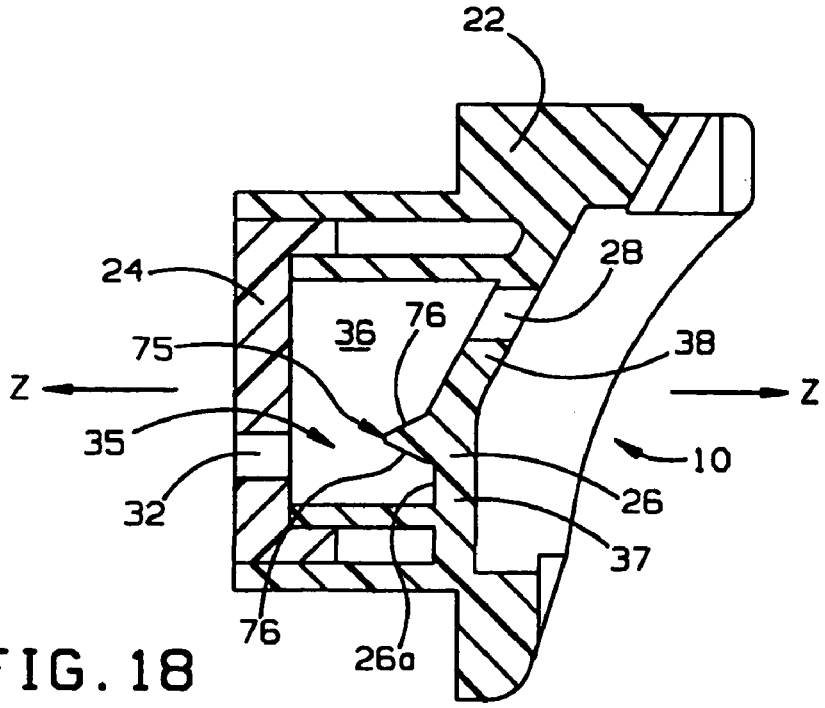
FIG. 18 is a cross-sectional view of another alternative exemplary nozzle embodying features of the present invention.
Figure 19:
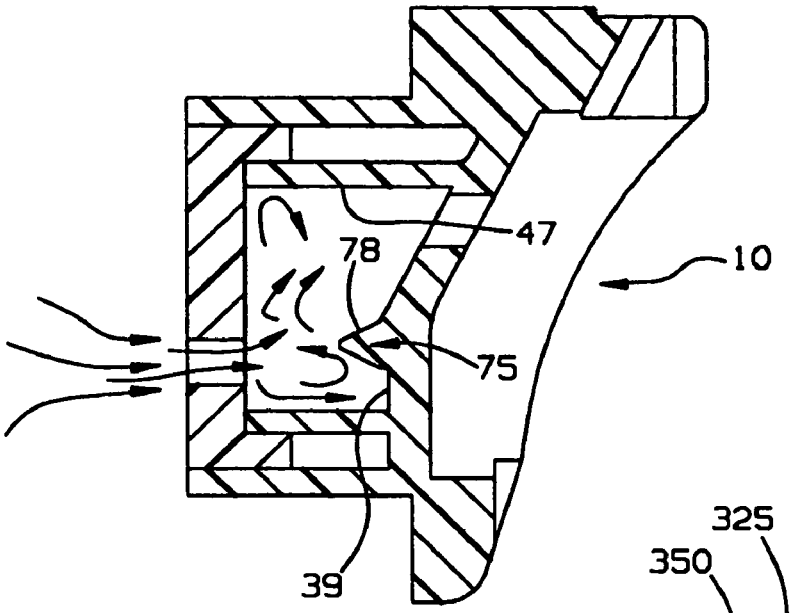
FIG. 19 is a cross-sectional schematic view of the nozzle of FIG. 18 illustrating exemplary flow vectors.

Referring to FIGS. 18 and 19, a modified nozzle 10 is illustrated, which is similar to the nozzle 10 shown in FIG. 4, but includes an obstruction 75 within the nozzle chamber 35. Preferably, the obstruction 75 is disposed within the fluid flow path between the nozzle inlet 32 and the nozzle outlet 28 within the nozzle chamber 35. The obstruction 75 generally imparts further turbulence to the fluid prior to the nozzle outlet 28 to further modify the fluid characteristics in the nozzle chamber 35, which further modifies the precipitation rate and/or range of the fluid stream 20.

More specifically, the obstruction 75 may be a ridge, ramp, boss, or other protruding obstruction that extends outwardly into the nozzle chamber 35 from the inside surface 26*a* of the exit wall 26*a*. As illustrated, the obstruction 75 is generally disposed on the exit wall inside surface 26*a* at the transition between the first portion 37 and the second portion 38. Preferably, the obstruction 75 is an elongated wedge having surfaces 76 that are angled inwardly toward each other. Optionally, the obstruction 75 may be angled relative to the longitudinal axis Z, and therefore, extend between the first portion 37 and the second portion 38.

One of the ramped surfaces 76 may also provide a third impact surface 78 within the fluid flow path, as illustrated in FIG. 19. For example, as the fluid enters the nozzle chamber 35, if the nozzle 10 includes the optional obstruction 75, the fluid preferably changes flow directions at least twice, and possibly three or more times, within the nozzle chamber 35 to impart greater turbulence to the fluid than the nozzle 10 without the obstruction 75. That is, as the fluid enters the nozzle chamber 35 via the nozzle inlet 32, a portion engages the first impact surface 39 as described previously and is redirected toward the third impact surface 78. A portion of such fluid then may engage the third impact surface 78 and be redirected generally toward the restrictor plate 24 to impart a greater level of turbulence to the fluid. A portion of the fluid may then flow upwardly to engage the second impact surface 47 prior to being discharged form the nozzle outlet 28. While the above description also provides a general flow path in the chamber 35, the turbulence therein may also include other currents, eddies, or flow vectors consistent with a turbulent flow profile.

Figure 20:
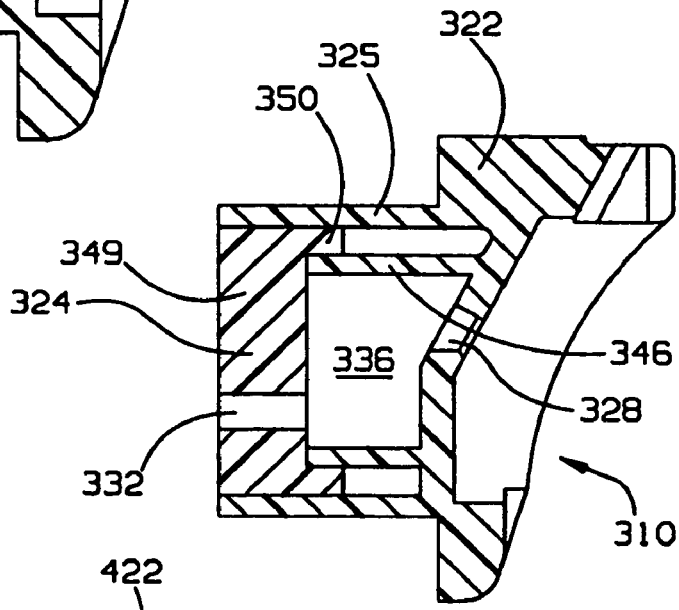
FIG. 20 is a cross-sectional view of another alternative irrigation nozzle embodying features of the present invention.
Figure 21:
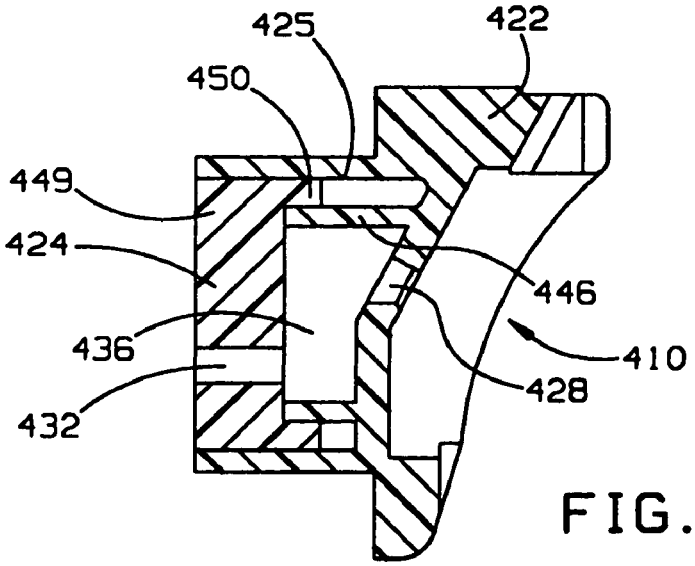
FIG. 21 is a cross-sectional view of another alternative irrigation nozzle embodying features of the present invention.

Referring to FIGS. 20 and 21, further modifications to a restrictor plate and nozzle combination are illustrated. For example, restrictor plate 324 (FIG. 20) and 424 (FIG. 21) include disk portions 349 and 449, respectively, having an increased thickness relative to the restrictor plate 24 so that a nozzle inlet 332 and 432 are formed with a longer conduit passage. For example, the thickness of the restrictor plates 324 and 424 may be about 0.1 inches thicker than the restrictor plate 24, or about 0.80 inches thick.

The increased thickness of the restrictor plate may either extend upstream or downstream. For example, as illustrated by a nozzle 310 in FIG. 20, the increased thickness of the restrictor plate 324 extends upstream so that the volume of a nozzle chamber 336 may be similar to the volume of the nozzle chamber 35. Accordingly, it will be appreciated that the axial lengths of the nozzle body side wall 325 and nozzle wall 324 would be altered accordingly to accommodate the modified plate 324. On the other hand, as illustrated by a nozzle 410 in FIG. 21, the increased thickness may extend downstream so that the volume of a nozzle chamber 436 is decreased relative to the volume of the nozzle chamber 35. Table 7 below provides examples of how the exemplary nozzles 310 and 410, with increased thickness restrictor plates, modify the fluid properties within the nozzles.

TABLE 7

Fluid properties of exemplary irrigation nozzles having an increased thickness (i.e., about 0.1 inches thicker) restrictor plate.

| Nozzle Configuration | Input Pressure, psi | Pressure in Nozzle Chamber, psi | Velocity at Nozzle Outlet, fps |
|---|---|---|---|
| Thickness extending upstream (i.e., nozzle 310) | 70 | 21-34 | 11-64 |
| Thickness extending downstream (i.e., nozzle 410) | 70 | 11-41 | 12-50 |

It will be understood that various changes in the details, materials, and arrangements of parts and components, which have been herein described and illustrated in order to explain the nature of the invention may be made by those skilled in the art within the principle and scope of the invention as expressed in the appended claims.

What is claimed is:

1. A nozzle for an irrigation sprinkler comprising:

a side wall having opposite ends, an outlet wall on one end of the side wall and defining a fluid outlet with a first cross-sectional area, an inlet wall on the other end of the side wall and defining a fluid inlet to the nozzle with a second cross-sectional area, and a central longitudinal axis extending through the inlet wall and the outlet wall;

a pressure regulating chamber extending substantially symmetrically around the nozzle central longitudinal axis and defined by the side wall, the outlet wall and the inlet wall;

the pressure regulating chamber positioned in the nozzle between the fluid inlet and the fluid outlet to collect a volume of the entire fluid stream in the nozzle pressure regulating chamber without any fluid bypassing the pressure regulating chamber; and the volume of the pressure regulating chamber defined by a dimension along the central longitudinal axis at least equal to a dimension transverse to the longitudinal axis to collect a sufficient amount of fluid to sufficiently equalize pressure variations of the fluid entering the nozzle so that a fluid stream being sprayed from the pressure regulating chamber through the fluid outlet is projected from the nozzle with a generally consistent throw distance and within about 2 feet from a target distance and with a distribution uniformity of about 80 percent or greater and a scheduling coefficient of about 1.3 or less regardless of the fluid pressure upstream of the inlet wall within a range between about 40 to about 100 psi.

2. The nozzle of claim 1, wherein at least a portion of the fluid inlet is offset from the fluid outlet.

3. The nozzle of claim 2, wherein the second predetermined cross-sectional area of the fluid inlet is less than the first predetermined cross-sectional area of the fluid outlet.

4. The nozzle of claim 3, wherein the fluid outlet comprises a plurality of orifices.

5. The nozzle of claim 3, wherein the fluid inlet comprises a plurality of openings.

6. The nozzle of claim 1, wherein the pressure regulating chamber causes a fluid flow stream in the chamber to be at least in part turbulent.

7. The nozzle of claim 6, wherein the outlet wall is generally aligned with the fluid inlet to aid in causing the fluid flow stream in the chamber to be at least in part turbulent.

8. The nozzle of claim 7, wherein the outlet wall includes a first portion generally aligned with the fluid inlet and a second portion defining the fluid outlet, the second portion being angled with respect to the first portion.

9. The nozzle of claim 7, wherein the side wall causes the fluid flow stream in the chamber to be at least in part turbulent.

10. The nozzle of claim 1, wherein the inlet wall comprises a disk portion having an outer periphery and an annular flange portion extending outwardly from the periphery, the disc portion defines the fluid inlet.

11. The nozzle of claim 10 further comprising an exterior wall being radially spaced from the side wall to define a slot to receive the flange portion of the inlet wall.

12. The nozzle of claim 11, wherein the flange portion is frictionally received in the slot to connect the inlet wall at the side wall.

13. The nozzle of claim 12, wherein the flange portion includes a plurality of deformable ribs to form a frictional fit between the flange portion and the slot.

14. The nozzle of claim 1 further comprising a throttling plate defining an throttle opening and being rotatively coupled to the inlet wall to be rotatable relative to the inlet wall, the throttling plate being rotated to selectively open and close the inlet a desired amount depending on the overlap of the throttling opening with the inlet.

15. The nozzle of claim 1 further comprising an obstruction in the chamber causing the fluid flow stream in the chamber to be at least in part turbulent.

16. The nozzle of claim 15, wherein the obstruction is a projecting rib extending into the chamber from the outlet wall.

17. The irrigation sprinkler nozzle of claim 16, wherein the rib has at least one ramped surface.

18. The irrigation sprinkler nozzle of claim 1, wherein the inlet wall comprises a relatively elongated nozzle passage.

19. The nozzle of claim 1, wherein a ratio of the first cross-sectional area of the fluid outlet to the second cross-sectional area of the fluid inlet is from about 0.7:1 to about 3:1.

20. The nozzle of claim 1, wherein a ratio of a third cross-sectional area of the pressure regulating chamber to the second cross-sectional area of the fluid inlet is at least about 2.6:1.

21. The nozzle of claim 20, wherein a ratio of the third cross-sectional area of the pressure regulating chamber to the first cross-sectional area of the fluid outlet is at least about 2.8:1.

* * * * *